United States Patent [19]

Mugford et al.

[11] Patent Number: 4,538,812

[45] Date of Patent: Sep. 3, 1985

[54] WEIGHT DEVICE FOR ATHLETIC RACKET

[76] Inventors: David B. Mugford, 137 Essex St., Chelsea, Mass. 02150; Sidney J. Guidicianne, 31 Old Country Rd., Saugus, Mass. 01906

[21] Appl. No.: 350,992

[22] Filed: Feb. 22, 1982

[51] Int. Cl.[3] ..... A63B 49/00

[52] U.S. Cl. ..... 273/73 R

[58] Field of Search ..... 273/29 A, 26 B, 193 A, 273/194 A, 194 B, 73 R, 73 G, 169, DIG. 19; 272/119, 67

[56] References Cited

U.S. PATENT DOCUMENTS

| | | | |
|---|---|---|---|
| 3,278,184 | 10/1966 | Rosenbaum | 272/119 |
| 3,490,766 | 1/1970 | Gardner | 272/119 |
| 3,924,851 | 12/1975 | Winston | 272/67 |
| 4,000,893 | 1/1977 | Evans | 273/73 R |
| 4,052,061 | 10/1977 | Stewart | 273/73 R |
| 4,142,721 | 3/1979 | Faleck et al. | 273/29 A X |

FOREIGN PATENT DOCUMENTS

| | | | |
|---|---|---|---|
| 563170 | 6/1975 | Switzerland | 272/119 |

*Primary Examiner*—Richard C. Pinkham
*Assistant Examiner*—Matthew L. Schneider

[57] ABSTRACT

A weight device for attachment to a tennis racket having two sheets separated by an elastic member. Each sheet contains a plurality of weights which are housed in chambers. The chambers are formed by the joining of two layers of flexible material at spaced locations.

4 Claims, 9 Drawing Figures

WEIGHT DEVICE FOR ATHLETIC RACKET

DESCRIPTION

TECHNICAL FIELD

The present invention relates to athletic rackets, and more particularly to devices for attaching, in a detachable manner, weights to athletic rackets.

BACKGROUND ART

Weights have been developed for attachment to and removal from a variety of athletic pieces, as disclosed, for example, in U.S. Pat. Nos. 3,834,697 (hockey stick), 3,398,961 (golf club), 3,971,559 (baseball bat), 3,944,225 (baseball bat), 3,716,239 (golf club), 3,521,883 (baseball bat), 3,623,724 (baseball bat), 2,608,409 (golf club), 3,458,203 (golf club), and 4,045,034 (golf club). In areas not necessarily analogous to the art of the present invention, removable weights for attachment to the arms or legs of the wearer have been disclosed in U.S. Pat. Nos. 3,427,020, 3,306,610, 3,528,652, 3,490,766 and 3,588,105.

DISCLOSURE OF INVENTION

The present invention provides a weight device for an athletic racket. The device includes a plurality of weight segments connected in a series so that longitudinal axes of the segments are generally parallel; an elastic member is connected at an end of the series of weight segments, and a latch removably latches the combination of the series of weight segments and elastic member into a physically closed loop. The closed loop surrounds a tubular member of the athletic racket. In a preferred embodiment, the series of weight segments is formed from a pair of sheets of a flexible material cojoined along a series of parallel lines so as to form a plurality of chambers, and granular weights are placed in each chamber. Also in a preferred embodiment, two series of weight segments are used, with the elastic member joining the series together at one set of ends thereof and the latch permitting linkage of the other set of ends.

BRIEF DESCRIPTION OF THE DRAWINGS

These and other features of the invention will be more readily understood by consideration of the following detailed description taken with the accompanying drawings, in which.

DESCRIPTION OF SPECIFIC EMBODIMENTS

Figure 1:
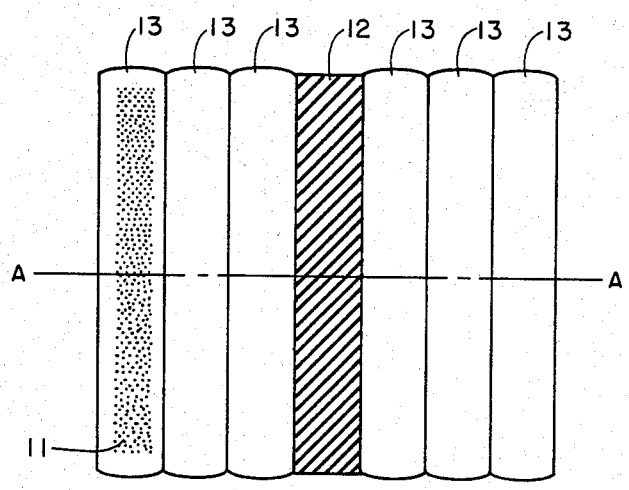
FIG. 1 is a view of a preferred embodiment of a weight device for an athletic racket in accordance with the present invention, with the device seen unlatched and in a flattened position.

Referring to FIG. 1, there is shown in an unlatched position a preferred embodiment of a weight device for an athletic racket in accordance with the present invention. The device is shown as viewed from its outer face. It comprises a plurality of weight segments 13 joined at their lengthwise edges, so that there is formed a series of weight segments. A left series of three weight segments in this embodiment is joined by an elastic member 12 to a right series of three segments.

Velcro-type material 11 is placed on the outside of the leftmost weight segment. The Velcro-type material referred to above and hereinafter is considered to be a hook and loop type of fastener.

Figure 2:
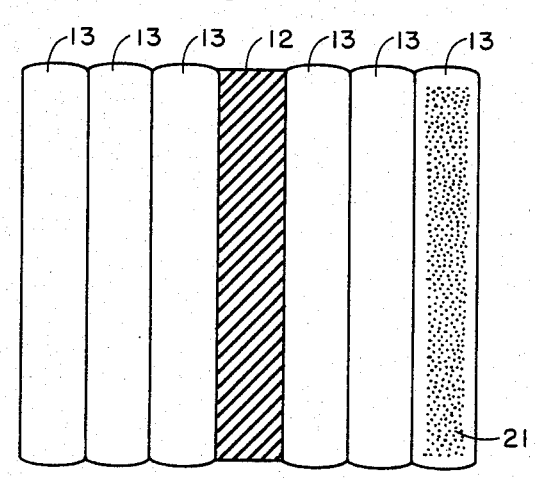
FIG. 2 is a view of the other side of the embodiment shown in FIG. 1.

When the embodiment of FIG. 1 is rotated 180° about the axis A—A shown in that figure, one obtains the view shown in FIG. 2 wherein the inside surface of the device is shown. (Throughout the description and figures herein, a given number identifies uniformly the same item in each of the figures.) The strip 21 of Velcro-type material shown in FIG. 2 mates with strip 11 shown in FIG. 1 when the device is affixed to a racket. The use of Velcro-type materials permits ready latching and unlatching of the device.

Figure 3:
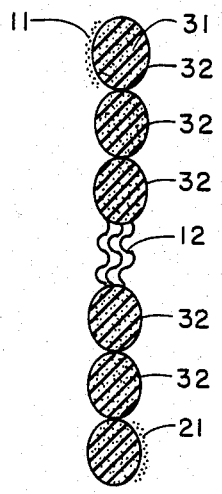
FIG. 3 is a cross-sectional view of the embodiment shown in FIGS. 1 and 2.

In FIG. 3 the device of FIGS. 1 and 2 is shown in cross-section. Each segment 13 shown in FIGS. 1 and 2 contains granular fill 31. The inside face 32 of each segment of the device is constructed of a non-slip material, which may, for example, be a rubberized fabric.

A convenient way of making the series of weight segments such as those shown in FIGS. 1–3 discussed above is to take two sheets of a flexible material (for example, rubberized fabric), and to join the sheets at parallel intervals. The resulting chambers between the sheets may then be filled with granular material, and the ends of the sheets may then be sealed. The sealing and joining may be accomplished, for example, by sewing and/or gluing.

Figure 4:
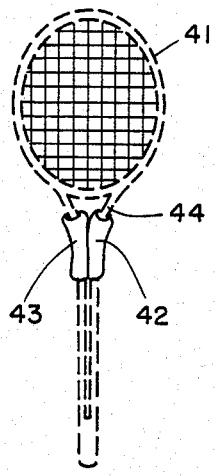
FIG. 4 illustrates use of a preferred embodiment of the invention with one type of racket.

In FIG. 4 is shown one design of a modern tennis racket 41 utilizing two devices 42 and 43 made in accordance with the present invention. Each device is fastened around a tubular member such as that indicated as item 44 in FIG. 4.

Figure 5:
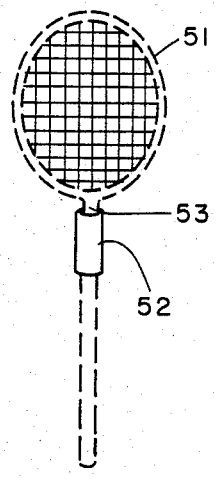
FIG. 5 shows use of the invention with another type of racket.

In FIG. 5 is shown another type of racket 51 having a tubular member 53 around which the device 52 is affixed.

The term "tubular member" as used in the present description and the following claims is not restricted, of course, to a member that is hollow, nor to one that is round. The device in accordance with the present invention may be employed successfully with tubular members that are solid and that are other than circular in cross-section.

Figure 6:
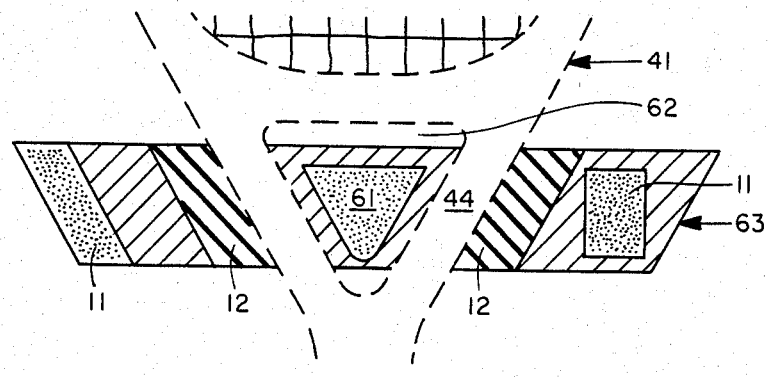
FIG. 6 presents a view of another preferred embodiment of the invention, for use with an athletic racket of the type having an opening in its frame.

FIG. 6 shows another preferred embodiment of the invention, for use with an athletic racket of the type having a opening in its frame. As indicated the racket 41 includes an opening 62 in its frame. A weight assembly 61 including a Velcro surface is placed on a sheet 63 of flexible material that includes elastic portions 12 and additional Velcro surfaces 11. In FIG. 6 the device is of course in an unlatched position with respect to the racket 41.

In the embodiment shown, in order to latch the device, the right hand side would be folded first around the tubular member 44 and the right hand Velcro portion 11 would connect with the mating Velcro on weight assembly 61. The left hand side of the devices is then folded over and the Velcro portion 11 is mated to a Velcro portion shown in FIG. 7 on the back of the right hand side of the sheet 63.

Figure 7A:
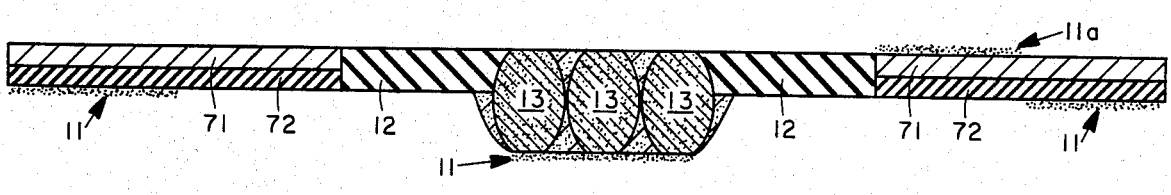
FIGS. 7A, 7B, and 7C present views respectively of a cross section, front, and back of the embodiment shown in FIG. 6.

In FIG. 7A the embodiment of FIG. 6 is shown in cross-section. The weight assembly 61 is shown to consist of three weight segments 13 on which are placed Velcro surface 11. The sheet 63 is shown to include a fabric portion 71 linked to elastic members 12 and weight segements 13. The inner surface 72 of the device is rubberized where it may come in contact with the racket frame so as to reduce the tendancy to slip. The Velcro on the rear portion of the right hand flap shown in FIG. 6 is shown in FIG. 7A as item 11A.

Figure 7B:
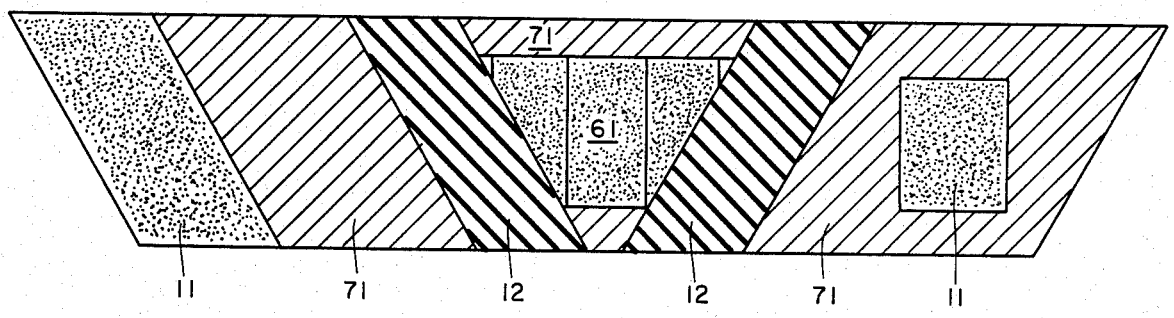
Figure 7C:
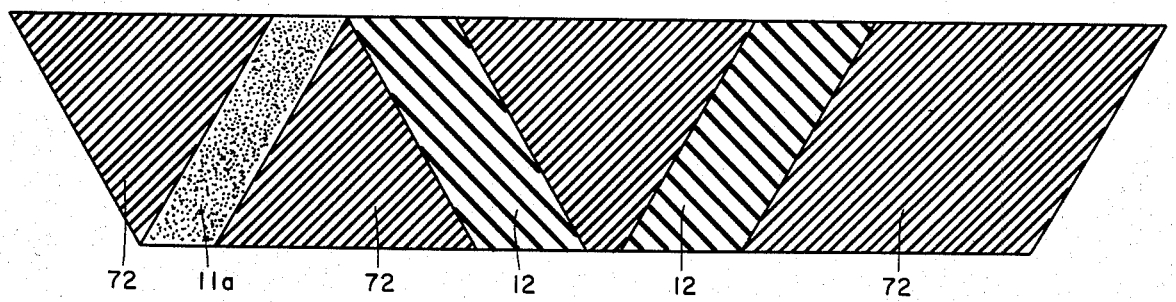

Referring now to FIG. 7B there is shown a front view of the embodiment shown in FIG. 6. Numbers identifing items in this figure and in the other figures of the description herein are used consistently throughout to identify items, so that the items numbered in this figure are as described with reference to FIGS. 6 and 7A. It should be noted that the weight assembly 61 in this embodiment may include the separate weight segments 13 as illustrated in FIG. 7A or it may include a single chamber containing granular weights. Alternatively, the weight may be of a solid material, such as lead or aluminum. FIG. 7C presents a rear view of the embodiment shown in FIG. 6.

Accordingly, while the invention has been described with particular reference to specific embodiments thereof, it will be understood that it may be embodied in a variety of forms diverse from those shown and described without departing from the spirit and scope of the invention as defined by the following claims.

What is claimed is:

1. The combination of an athletic racket having a tubular member, with a weight device for detachable affixation to such athletic racket, said device comprising:

first and second flexible sheets, said first sheet and said second sheet each having first and second sides, said first sides comprising non-slip surfaces having a high coefficient of friction with respect to the surface of the tubular member;

at least one weight attached to each flexible sheet;

an elastic member distinct from the non-slip surface and integrally attached to the first and second sheets for elastically separating the sheets into two weight-bearing portions which by stretching of the elastic member may be variably spaced apart from each other so as to position the weights on substantially opposing sides of the racket while tensioning the sheets; and latch means, for removably latching the first and second sheets together into a physically closed loop around the tubular member so as to maintain the elastic tension of the sheets while frictionally securing the weights in opposing balanced positions around the racket.

2. A combination in accordance with claim 1, wherein the first and second sheets each have a plurality of weights attached thereto, said first sheet and said second sheet each comprising first and second layers coextensively disposed in generally parallel planes, said layers being joined to one another along a series of at least four parallel lines so as to form between the layers, a plurality of chambers, said plurality of weights being located in said chambers and said chambers having longitudinal axes;

the parallel lines, the elastic member and the longitudinal axes of said chambers all being substantially parallel to a central axis of the tubular member thereby permitting flexible disposition of the device around the tubular member for assuring conformal contact of the respective non-slip surface and the tubular member.

3. A combination in accordance with claim 2 wherein the latch means comprises mating strips of hook and loop-type material.

4. A combination, in accordance with claim 3 wherein the weights are granular.

* * * * *